United States Patent [19]

Hentschel

[11] Patent Number: 4,729,693

[45] Date of Patent: Mar. 8, 1988

[54] TUNNEL EXCAVATOR

[75] Inventor: Volker Hentschel, Dorsten, Fed. Rep. of Germany

[73] Assignee: Hochtief Aktiengesellschaft Vorm, Gebr. Helfmann, Essen, Fed. Rep. of Germany

[21] Appl. No.: 909,128

[22] Filed: Sep. 18, 1986

[30] Foreign Application Priority Data

Sep. 19, 1985 [DE] Fed. Rep. of Germany ..... 3533425

[51] Int. Cl.[4] ..... E21D 9/06

[52] U.S. Cl. ..... 405/144; 299/33

[58] Field of Search ..... 405/141, 143, 144; 299/33, 31

[56] References Cited

U.S. PATENT DOCUMENTS

| | | | |
|---|---|---|---|
| 3,379,024 | 4/1968 | Wohlmeyer | 405/143 X |
| 4,311,344 | 1/1982 | Akesaka | 299/33 |

FOREIGN PATENT DOCUMENTS

| | | |
|---|---|---|
| 45562 | 4/1888 | Fed. Rep. of Germany . |
| 2709739 | 9/1978 | Fed. Rep. of Germany . |
| 2705580 | 5/1979 | Fed. Rep. of Germany . |
| 2227083 | 7/1981 | Fed. Rep. of Germany . |
| 3127311 | 2/1983 | Fed. Rep. of Germany . |
| 2760000 | 4/1983 | Fed. Rep. of Germany . |
| 2654422 | 1/1985 | Fed. Rep. of Germany . |

OTHER PUBLICATIONS

Brochure "La Ligne D du Metro Lyonais" Semaly Information No. 5 AFTS Symposium, Nov. 27–29, 1984.

Abstract of Lecture from the Proceedings of an International Symposium of the AFTS, Lyon/Nov. 27–29 1984, p. 25.

Metro Information No. 11, Jan. 1984, Semaly, p. 27.

Brochure Metro de Lyon Sous Fluviale Ligne D, p. 4, Principe D–avancement du bouclier, FIGS. 1 to 4, Nov. 27–29 1984.

Schematic Mixschild Baustelle HERRA Hamburg.

*Primary Examiner*—David H. Corbin

*Attorney, Agent, or Firm*—Karl F. Ross; Herbert Dubno

[57] ABSTRACT

The digging tool of the tunnel excavator is mounted on a shield support and operates in a forward digging chamber. The digging chamber is sealed from a tunnel formed by the excavator by a separating wall of the excavator across a transverse cross section of the excavator. The digging chamber is filled with a fluid which supports the forward digging chamber wall. The problems resulting from the incompressibility of the supporting fluid can be handled simply when the digging chamber, with at least a portion of its separating wall, is supported so as to be movable longitudinally back and forth by an adjustable spring device. Advantageously, the spring device comprises a plurality of hydraulic cylinder devices whose cylinders are connected to a hydraulic accumulator under gas pressure.

9 Claims, 3 Drawing Figures

TUNNEL EXCAVATOR

CROSS-REFERENCE TO RELATED APPLICATIONS

This application is related to Ser. No. 717,824 filed Mar. 29, 1985; Ser. No. 690,163 filed Jan. 10, 1985; Ser. No. 674,895 filed Nov. 26, 1984; and Ser. No. 713,462 filed Mar. 19, 1985 (U.S. Pat. No. 4,568,202).

FIELD OF THE INVENTION

My present invention relates to a tunnel excavator and, more particularly, to a tunnel excavator with a shield which is advanced behind the excavation chamber which is filled with a wall-support liquid.

BACKGROUND OF THE INVENTION

A known shield-type tunnel excavator comprises a digging tool mounted on a shield which is advanced as excavation proceeds in a forward digging chamber which is sealed by a separating wall of the excavator shield from the tunnel already formed behind the shield.

The tunnel is usually not under an elevated pressure.

The separating wall is of the transverse cross section of the excavator and the digging chamber is filled with a fluid supporting the forward face at which digging is effected. The drive of the excavating tool and the removal of the excavated material is effected through this separating wall.

Various forms of shielded tunnel excavators are known as described, for example, in German Patent DE-PS No. 27 60 000, German Open Patent Application DE-OS No. 27 09 739 and German Printed Patent Application DE-AS No. 27 05 580. They are used in soft, water-bearing earth in which the tunnel should not be under excessive pressure and the soft local forward wall of the digging chamber is sustained with a pressurized viscous liquid, forming the supporting fluid.

Thus it is important to keep the volume excavated in correct relation to the excavation speed and to the transport rate of excavated material, because the supporting fluid is incompressible.

Especially when too much material is excavated and removed in relation to the tunneling distance the danger of settling exists, because the pressure of the supporting liquid may drop.

With these tunnel excavators one tries to maintain the pressure of the supporting fluid in the digging chamber constant with the help of expensive control mechanisms. However, the goal of these control mechanisms is attained only very incompletely. When the viscosity of the supporting fluid is high it is particularly difficult to keep the pressure constant since a measurement valid for the entire cross section is not possible and the filling and/or amount of the supporting fluid is subject to continual fluctuations in the earth removal required by the excavation.

OBJECTS OF THE INVENTION

It is an object of my invention to provide an improved tunnel excavator, which overcomes the above-described drawbacks.

It is also an object of my invention to provide an improved tunnel excavator which with comparatively simple technical means brings about an adjustment of the parameters influencing the pressure of the supporting fluid in the digging chamber.

It is yet another object of my invention to provide an improved tunnel excavator for comparatively soft, water-bearing earth, which provides a supporting fluid for the forward wall of the digging chamber and maintains the pressure of this supporting fluid in a comparatively simple inexpensive way.

SUMMARY OF THE INVENTION

These objects and others which will become more readily apparent hereinafter are attained in accordance with my invention in a tunnel excavator comprising a digging tool mounted on a shield support operating in a front digging chamber, which is sealed with a separating wall of the tunnel excavator extending across the full cross section of the tunnel formed by the excavator and not under an elevated pressure from behind the wall. The digging chamber is filled with a fluid supporting the forward digging chamber wall and held in the chamber by the separating wall.

According to my invention, at least a portion of the separating wall bounding the digging chamber is supported on the shield support by an adjustable spring device movable back and forth longitudinally.

The invention is intended to make the incompressible supporting fluid behave as if it were compressible by changing the volume of the digging chamber, while maintaining the pressure of the supporting fluid.

This is achieved by making at least a portion of the separating wall movable relative to the shield support.

The reaction force on the digging chamber and/or the supporting wall is transmitted to the shield support by the spring device not rigidly, but resiliently.

It is important that the flexible support be provided in such a way that no forces are borne by the inelastic components, particularly the shaft of the digging tool traversing the separating wall. The spring device can be precompressed to provide the suitable reaction force on the local forward wall of the digging chamber. The precompression is varied selectively with the components in their basic configuration and adjusted to fit the supporting pressure to be provided.

The entire separating wall can be supported so as to be movable back and forth and then sealed to the outer shield wall at the plane of separation. Alternatively, substantially the entire digging chamber is movable back and forth relative to the shield support and the separating wall can then be rigidly connected with a front outer shield ring.

The spring device advantageously comprises a plurality of hydraulic cylinder devices whose tunnel side cylinders are connected with a gas-pressure cushion, particularly a high pressure hydraulic accumulator. The yieldable volume of the hydraulic accumulator is selected so that the entire digging chamber can be displaced toward the forward wall a definite distance without changing the gas pressure substantially.

Thus discrepancies between the dug volume flow rate and the product transport volume flow rate are compensated without influencing the pressure in the incompressible fluid.

By detection of the displacement, the hydraulic cylinders, a guiding measure for control of the digging process and the feed process is provided. Furthermore, the resiliently mounted digging chamber also can be used for control of the digging tool.

According to a particularly simple and desirable embodiment the gas-supply device, comprises a single high pressure gas reservoir associated or connected with all the hydraulic cylinder devices.

For making adjustments to different earth pressures over the entire tunnel cross section in another embodiment according to our invention the gas supply device can comprise a plurality of high pressure gas supply reservoirs corresponding in number to the plurality of hydraulic cylinder devices used in the tunnel excavator, each of the high pressure gas supply reservoirs being connected to a respective hydraulic cylinder device.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
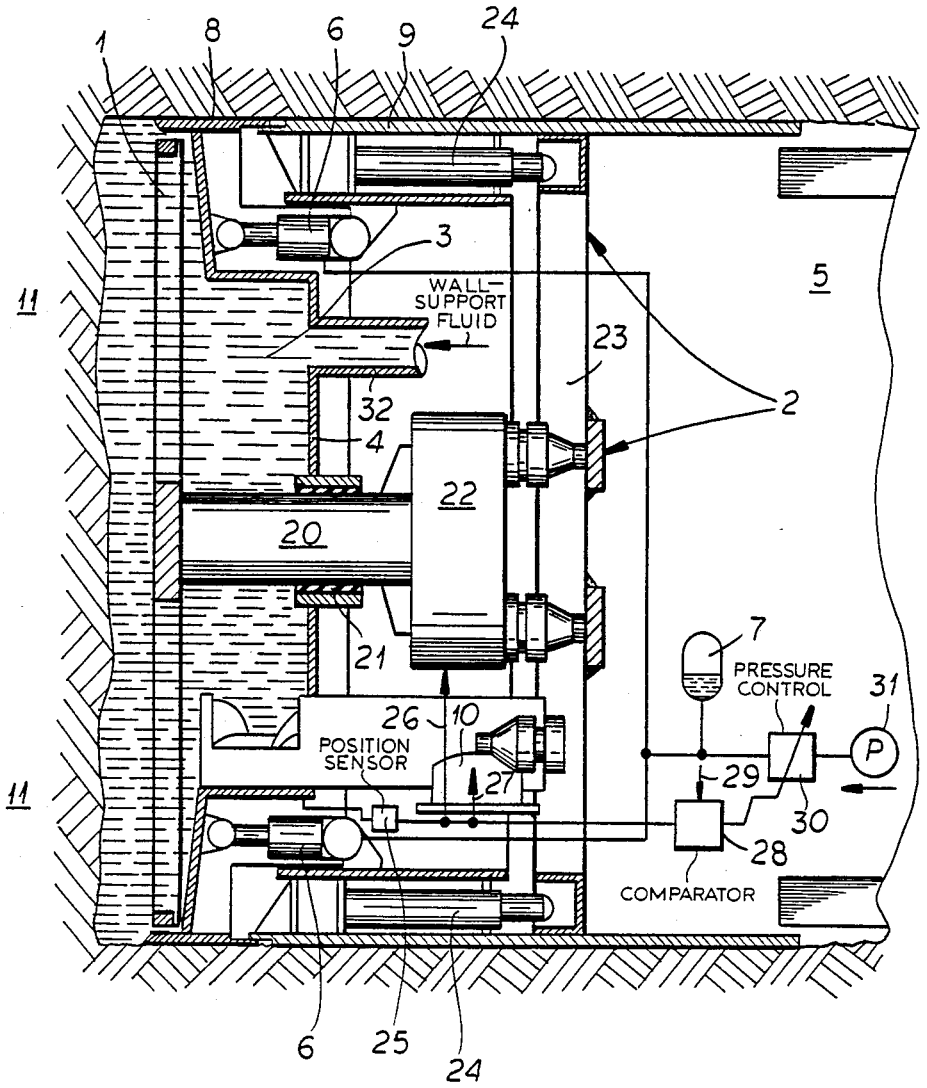
FIG. 1 is a partially cutaway longitudinal cross sectional view through a tunnel excavator according to our invention.

The shielded tunnel excavator shown in the drawing has a digging, breaking or mining tool 1 formed like a cutting wheel which operates in a forward digging chamber 3 and which is mounted on a shield support 2 of the tunnel excavator.

The digging chamber 3 is sealed from the tunnel 5, which is not under a particularly high pressure, by a separating wall 4 coextensive with the transverse cross section of the excavator tunnel and is filled with a fluid supporting the local forward wall 11 of the digging chamber 3.

In the embodiment of FIG. 1, the entire separating wall 4 for the digging chamber 3 is supported so as to be movable back and forth longitudinally by an adjustable spring device 6,7.

Furthermore the separating wall 4 is attached to a front outer shield support ring 8 which with its rear end overlaps and fits into the wall 9 of the shield support 2.

The spring device 6,7 comprises a plurality of hydraulic cylinder devices 6 positioned longitudinally which are pivotally connected with their front ends on the separating wall 4 and their rear ends on the shield support 2.

The tunnel side cylinders of these hydraulic cylinder devices 6 are connected to a high pressure hydraulic accumulator 7 as has been shown in the drawing. In FIG. 1 the accumulator is connected jointly with all the hydraulic cylinder devices 6.

The tool 1 is driven by a shaft 20 traversing the wall 4 at a seal 21 and a motor 22 mounted on the support ring 23. The shield is advanced by cylinders 24 in the usual manner.

The position sensor 25 can measure the displacement of the wall 4 relative to the balance of the shield structure 2. This measurement can provide a control 26 for the motor 22 regulating the tool 1, a control 27 to regulate the device 10 removing excavated material and, if desired, a control which allows variation of the pressure maintained by the accumulator 7. In this arrangement, the position sensor 25 provides an actual value input to a comparator 28 whose setpoint value 29 can be varied as a function of the earth conditions encountered by the tunneling machine. The output of the comparator 28 can control a valve 30 connected to a hydraulic pressure source 31. Also traversing the wall 4 is a conduit 32 for supplying the excavating face supporting liquid to the chamber. Similar control arrangements can be provided in the embodiments of FIGS. 2 and 3 as well.

The excavated earth is carried off by a conveyor 10 which penetrates the separating wall 4. Mechanisms provided for preventing or eliminating mud sedimentation in the digging chamber 3 are provided but have not been shown. The mud sedimentation can lead to a large earth resistance at the separating wall 4.

Figure 2:
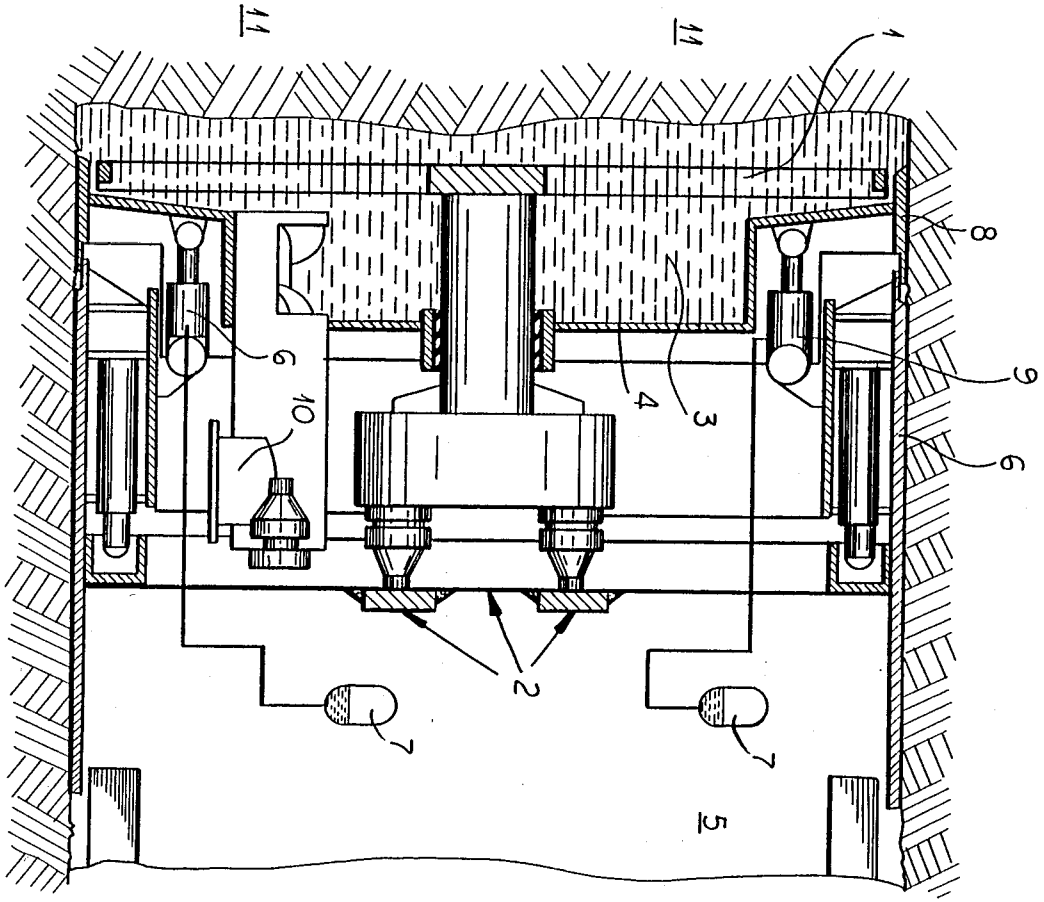
FIG. 2 is a partially cutaway longitudinal cross sectional view through another embodiment of a tunnel excavator according to our invention having a separate gas supply reservoir connected to each hydraulic cylinder device.

FIG. 2 shows another embodiment of the tunnel excavator of our invention in which each hydraulic cylinder device 6 is connected to its own separate hydraulic gas/accumulator 7. This embodiment allows compensations to be made for different earth resistance at the top and bottom of the digging chamber 3.

Figure 3:
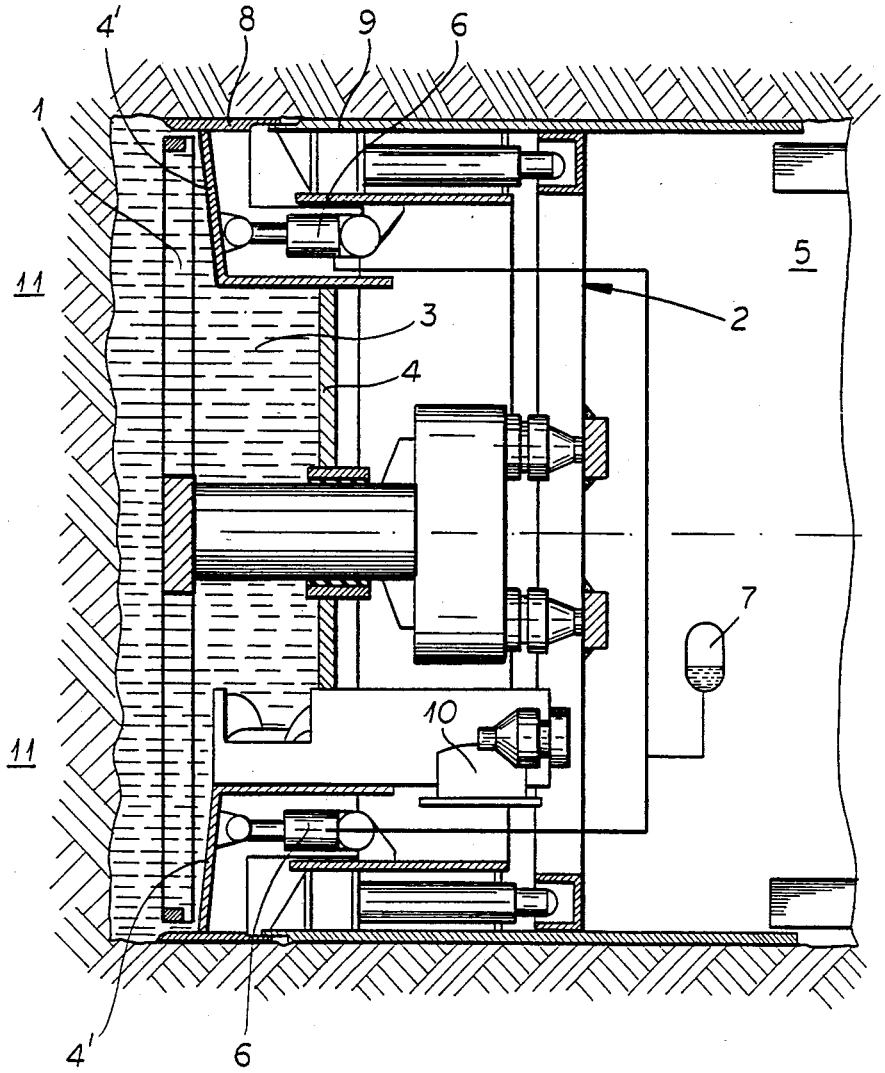
FIG. 3 is a partially cutaway longitudinal cross sectional view through a third embodiment of a tunnel excavator according to my invention.

FIG. 3 shows an additional embodiment of the tunnel excavator of our invention in which only a portion 4' of the separating wall 4 is movable. That portion 4' of the separating wall 4 is located at the outer periphery of a transverse cross section of the tunnel excavator.

We claim:

1. In a tunnel excavator comprising a digging tool mounted on a shield support operating in a front digging chamber, which is sealed by a separating wall of said tunnel excavator across transverse cross section of said tunnel excavator from a tunnel formed behind said tunnel excavator not under an elevated pressure, said digging chamber being filled with a supporting fluid supporting a local forward wall of said digging chamber, the improvement wherein said digging chamber has a changeable volume and at least a portion of said separating wall is supported on and adjustable relative to said shield support by an adjustable spring device so as to render said portion movable back and forth longitudinally relative to said support.

2. The improvement defined in claim 1 wherein the entire separating wall is supported so as to be movable back and forth on said shield support.

3. The improvement defined in claim 2 wherein said separating wall together with a rigid front outer shield ring attached to said separating wall is movable back and forth relative to said shield support.

4. The improvement defined in claim 3 wherein said spring device comprises a plurality of hydraulic cylinder devices whose cylinders are each connected to a hydraulic accumulator under gas pressure.

5. The improvement defined in claim 4 wherein a single accumulator comprises a single gas reservoir connected jointly with all of said hydraulic cylinder devices.

6. The improvement defined in claim 4 wherein said gas supply device comprises a plurality of accumulators each one of which is connected to a respective one of said hydraulic cylinder devices.

7. A tunnel excavator comprising:

a digging tool mounted on a shield support operated in a digging chamber filled with a supporting fluid supporting a local forward wall of said digging chamber, said chamber having a changeable volume, a separating wall sealing said digging chamber from a tunnel formed by said tunnel excavator not under an excessive pressure, said separating wall being supported on and adjustable relative to said shield support by an adjustable spring device so as to be movable back and forth longitudinally; and a gas-pressurized hydraulic accumulator connected to a plurality of hydraulic cylinder devices which act as said adjustable spring device for positioning said separating wall.

8. A tunnel excavator defined in claim 7 wherein a single accumulator connected to a plurality of said hydraulic cylinder devices forming said spring device.

9. A tunnel excavator defined in claim 7 wherein a plurality of high pressure accumulators are provided, each of which is connected to a respective one of said hydraulic cylinder devices.

* * * * *